US006304739B1

(12) United States Patent
Katsuyama et al.

(10) Patent No.: US 6,304,739 B1
(45) Date of Patent: Oct. 16, 2001

(54) TONER CONTAINER AND IMAGE FORMING APPARATUS USING THE SAME

(75) Inventors: Goro Katsuyama, Kanagawa; Masaaki Kabumoto, Chiba; Kanae Nomura, Tokyo; Seiji Terazawa, Shizuoka, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/420,578

(22) Filed: Oct. 19, 1999

(30) Foreign Application Priority Data

Oct. 19, 1998 (JP) ..... 10-297241
Oct. 4, 1999 (JP) ..... 11-282380

(51) Int. Cl.[7] ..... G03G 15/08

(52) U.S. Cl. ..... 399/262; 222/DIG. 1; 399/119

(58) Field of Search ..... 399/262, 35, 106, 399/111, 119; 222/DIG. 1; 220/23.2, 23.6, 23.8, 23.83

(56) References Cited

U.S. PATENT DOCUMENTS 4,561,567 * 12/1985 Wittstein et al. .
4,839,691 * 6/1989 Tagawa et al. ..... 399/119 X
5,074,344 * 12/1991 Vacek et al. ..... 399/262 X
5,079,591 * 1/1992 Tomita et al. ..... 399/262
5,266,998 * 11/1993 Lee ..... 399/119 X
5,449,095 * 9/1995 Kobayashi ..... 222/DIG. 1 X
5,742,877 * 4/1998 Okada et al. ..... 399/106
5,802,431 * 9/1998 Nagashima et al. ..... 399/262
5,887,232 * 3/1999 Phillips et al. ..... 399/262
5,978,632 * 11/1999 Kimura et al. ..... 222/DIG. 1 X
5,995,783 * 11/1999 Garcia et al. ..... 399/262 X

FOREIGN PATENT DOCUMENTS 55-21028 * 2/1980 (JP) .
55-21030 * 2/1980 (JP) .
1-105974 * 4/1989 (JP) .
4-9082 * 1/1992 (JP) .
4-166865 * 6/1992 (JP) .
6-11963 1/1994 (JP) .
6-298240 10/1994 (JP) .
7-26133 6/1995 (JP) .
7-219326 * 8/1995 (JP) .
7-55567 12/1995 (JP) .
8-171331 * 7/1996 (JP) .
10-133464 5/1998 (JP) .

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

A toner container for powdery toner for an electrophotographic image forming apparatus includes a toner discharge surface having a toner outlet configured to discharge the toner, a side surface perpendicularly extending from the toner discharging surface, and a slanted side surface facing the side surface and extending outwardly from the toner discharging surface.

59 Claims, 9 Drawing Sheets

TONER CONTAINER AND IMAGE FORMING APPARATUS USING THE SAME

BACKGROUND OF THE INVENTION

The present invention relates to a toner container for storing powdery toner and an image forming apparatus using the same.

Generally, a toner container for the above application is removably mounted to an image forming apparatus so as to replenish toner to a developing section included in the apparatus. Typical of the toner container is a hollow cylindrical toner bottle formed of plastics. The toner bottle or hard bottle may be rotated about its own axis in order to replenish toner stored therein to a developing device. A toner bottle for exclusively implementing the transport of toner from a manufacturer to a user is also conventional and also has a hollow cylindrical configuration which is easy to form by blow molding.

It has been customary to store the above toner bottle in an upright position before use because such a position reduces the area to occupy or enhances stability when the bottle is taken out of, e.g., a corrugated cardboard box. However, the problem with the upright position is that the weight of toner stored in the toner bottle increases for a unit area, causing the toner to easily cohere. Further, a problem arises when the hard toner bottle runs out of toner and is replaced with anew toner bottle. Specifically, it is a common practice for a manufacturer to collect the used toner bottle from the user's station for recycling, reusing or incinerating it. The hard toner bottle has a substantial volume and therefore increases the delivery cost for collection.

In light of this, a toner container capable of being reduced in volume has been proposed in the past. However, when toner stored in this kind of toner container is replenished via a toner replenishing device, stable replenishment cannot be guaranteed at the present stage of development. For easy transport and collection, toner may be stored in a toner container capable of having its volume reduced. However, this toner container is cut open at the time of tone replenishment and cannot meet the need for periodic replenishment.

Technologies relating to the present invention are disclosed in, e.g., Japanese Patent Laid-Open Publication Nos. 6-11963 and 6-298240, Japanese Utility Model Publication Nos. 7-26133 and 7-55567, and Japanese Patent Laid-Open Publication No. 10-133464.

SUMMARY OF THE INVENTION

It is therefore an object of the present invention to provide a toner container capable of reducing the cohesion of toner during storage and capable of being reduced in volume, as desired, and an image forming apparatus using the same.

In accordance with the present invention, in a toner container for storing powdery toner to be used in an electrophotographic image forming apparatus, the body of the toner container includes a toner discharge surface formed with a toner outlet for discharging the toner, and at least two flat surfaces. Also, in accordance with the present invention, an image forming apparatus using a toner container storing powdery toner and including a toner discharge surface formed with a toner outlet and at least two flat surfaces includes a body for allowing the toner container to be removably set thereon, and a developing device to which the toner is replenished from the toner container. The toner is transferred from the toner container to the developing section, as needed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
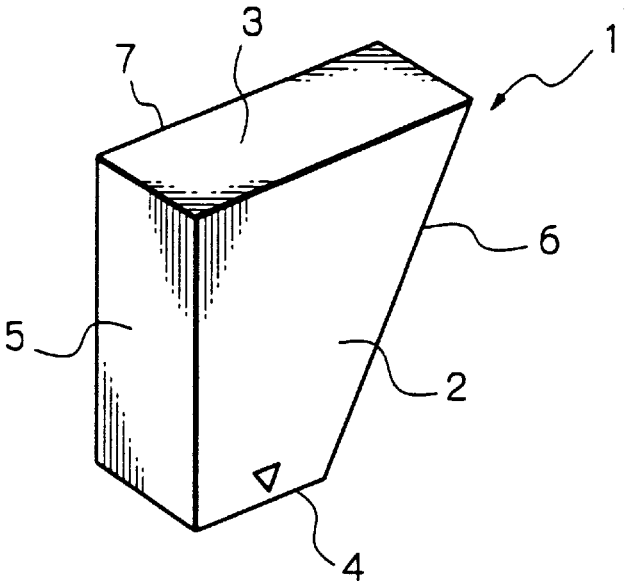
FIG. 1 is an isometric view showing a toner container embodying the present invention.
Figure 2:
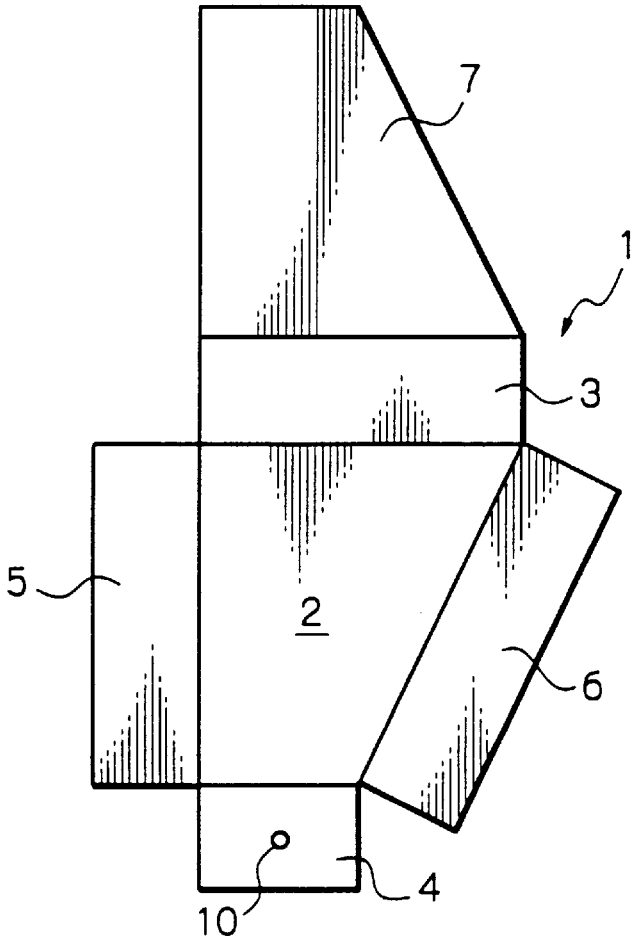
FIG. 2 is a developed view of the toner container.

Referring to FIGS. 1 and 2, a toner container embodying the present invention is shown and generally designated by the reference numeral 1. As shown, the toner container 1 is implemented as a hermetically sealed box having six flat surfaces, i.e., a front 2, a top 3, a bottom 4, two sides 5 and 6, and a rear 7. The front 2 and rear 7 are identical in size and shape, and each is sequentially reduced in width toward the bottom in a trapezoidal configuration. The front 2 and rear 7 each have a greater area than the other four surfaces. The top 3, bottom 4 and two sides 5 and 6 have substantially the same width, so that the front 2 and rear 7 are parallel to each other.

Figure 3:
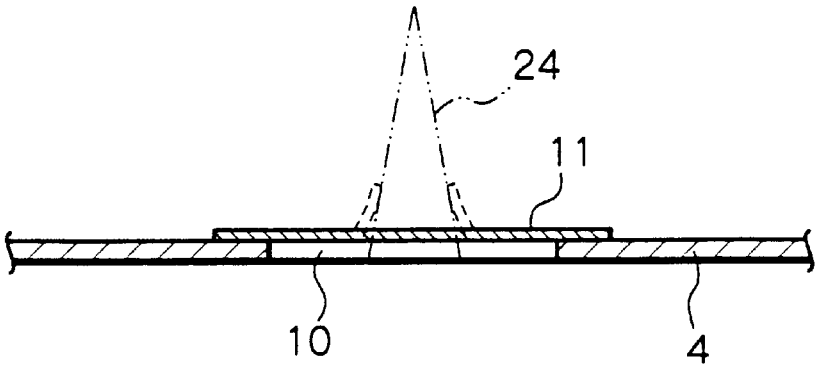
FIG. 3 is a section showing a toner outlet formed in the toner container.

A hole or toner outlet 10 is formed in the bottom 4 of the toner container 1 for discharging toner stored in the container 1. As shown in FIG. 3, the hole 10 is closed by a seal 11 before the toner container 1 is used.

Figure 4:
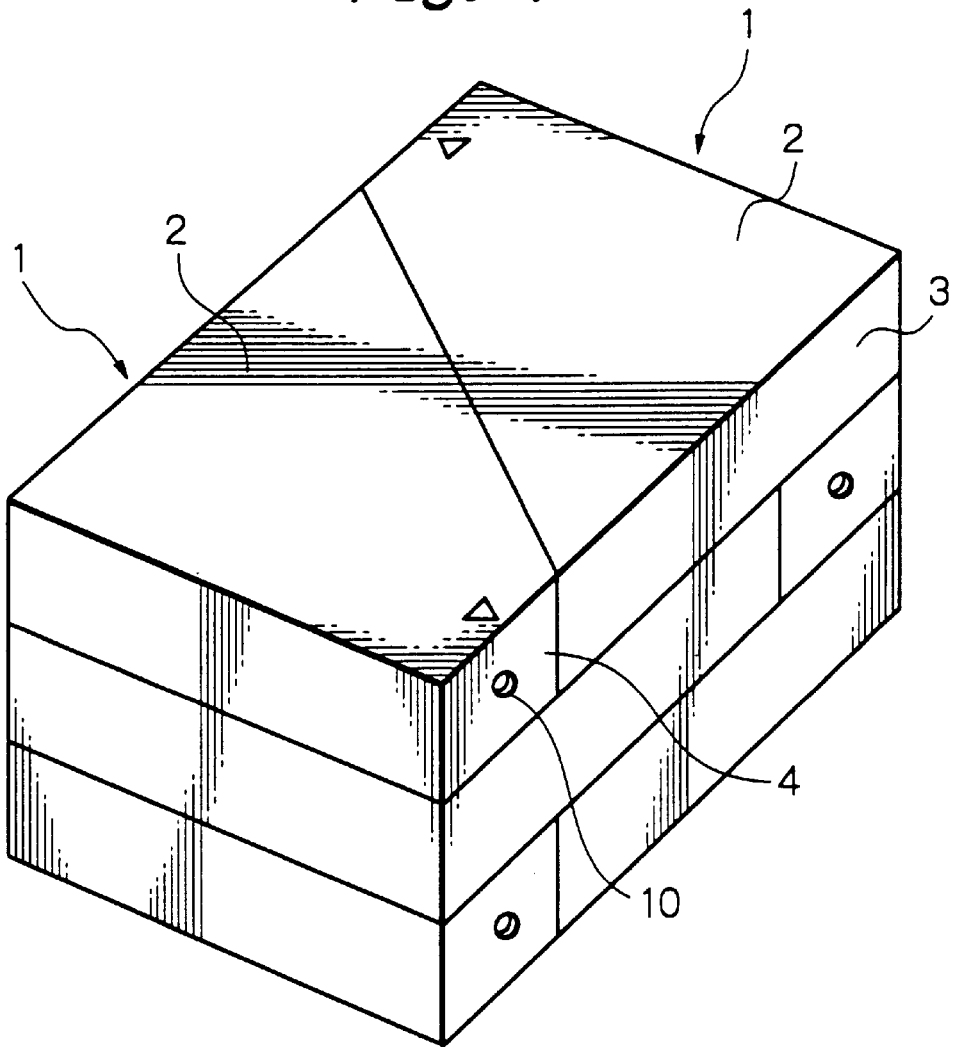
FIG. 4 is an isometric view showing a stack of toner containers each having the configuration of FIG. 1.

As shown in FIG. 4, a plurality of toner containers 1 each having the parallel front 2 and rear 7 can be stacked for storage. In addition, the toner containers 1 can be stably stacked without falling down because the front 2 and rear 7 each have a greater area than the other four surfaces. Further, in the position shown in FIG. 4, the weight to act on toner existing in the lower portion of each toner container 1 for a unit area decreases, compared to, e.g., the upright position shown in FIG. 1. This is successful to allow a minimum of toner to cohere during, e.g., a long time of storage.

It is to be noted that the toner container 1 may have any other suitable configuration so long as it is solid and includes two substantially parallel, relatively broad surfaces like the front 2 and rear 7. For example, the toner container 1 may be polygonal or the combination of curved surfaces and flat surfaces.

The trapezoid of each of the front 2 and rear 7 is formed by cutting a quadrilateral having four right-angled corners with a line extending obliquely from one side to another side facing it. Assume that the quadrilateral is a rectangle of a size corresponding to, e.g., a standardized size A4 or A5, and that the resulting trapezoid has an area which is one half of the area of the rectangle. Then, two trapezoids having the same area are produced from a single rectangle of standardized size. Therefore, as shown in FIG. 4, when two toner cartridges 1 are combined, they have the standardized size. It follows that the toner containers 1 of a given size can share the same packing boxes as sheets of the same size.

Usually, commercially available PPC sheets of size A4, for example, are packed in a corrugated cardboard box in five sets each having 500 sheets. Therefore, if two toner containers 1 has the size A4 when combined, and if the top 3, bottom 3 and sides 5 and 6 defining the thickness of each container 1 have the same dimensions a single set of 500 sheets, the containers 1 can share packing boxes with the sheets more easily. Moreover, the toner containers identical in size with sheets when combined can be neatly stored at the same time at the same place as the sheets or can even be delivered together with the sheets.

If two trapezoidal toner containers 1 have the size A5 when combined, but a packing box has the size A4, then four toner containers 1 should only be arranged in the format A4.

The toner container 1 is formed of a flexible material, e.g., paper, plastic film, aluminum foil or a mixture thereof. The toner container 1 with flexibility can be easily reduced in volume by, e.g., bending or folding after it has run out of toner. This promotes efficient collection and transport and thereby reduces the delivery cost for collection. Moreover, when the toner container 1 is formed of paper, it can be produced at a lower cost than the conventional hard bottle and can be recycled after use. In addition, the toner container 1 can even be formed of recycled paper.

Figure 5A:
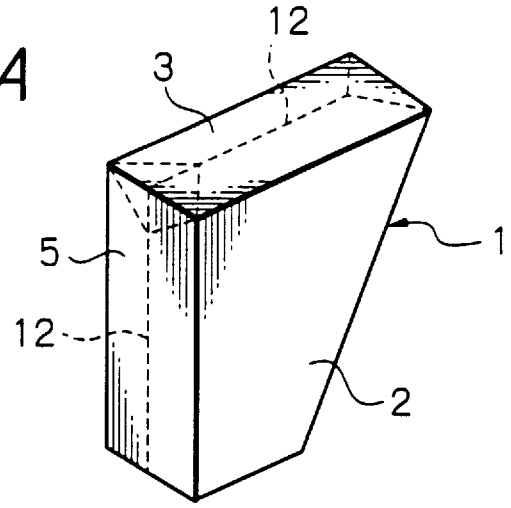
FIGS. 5A–5C are isometric views demonstrating how the toner container of the illustrative embodiment is collapsed.
Figure 5B:
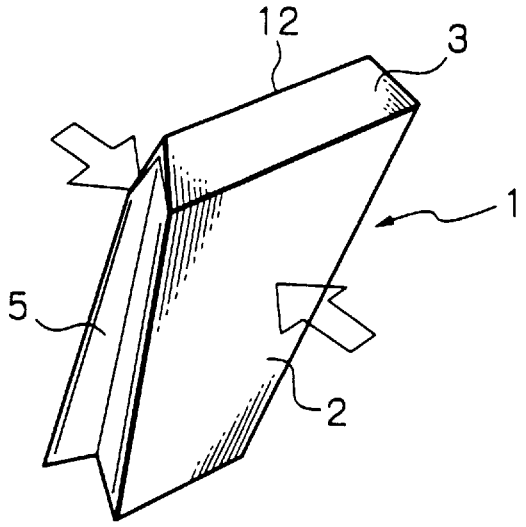
Figure 5C:
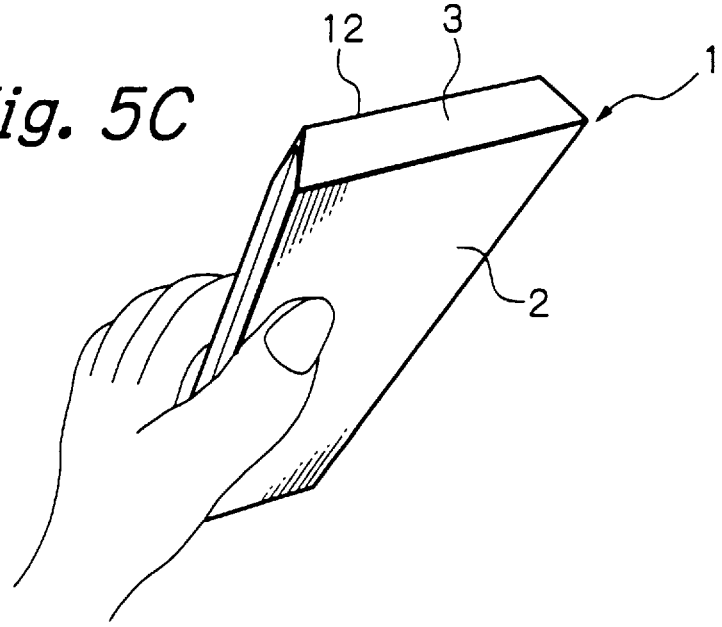

When the toner container 1 is formed of paper or plastic film as hard as, e.g., a milk pack, it needs some effort for a person to bent or fold the container 1 by hand. FIG. 5A shows an implementation for allowing the toner container 1 which is flexible, but slightly hard, to be easily reduced in size. As shown, the top 3, bottom 4 and two sides 5 and 6 of the toner container 1 (only the top 3 and left side 5 are visible) are provided with folds 12 beforehand, as indicated by dashed lines. As shown in FIG. 5B, after the toner container 1 has been used, its front 2 and rear 7 are pushed toward each other by hand in order to reduce the volume of the container 1. As a result, the toner container 1 easily collapses along the folds 12, as shown in FIG. 5C.

Figure 6:
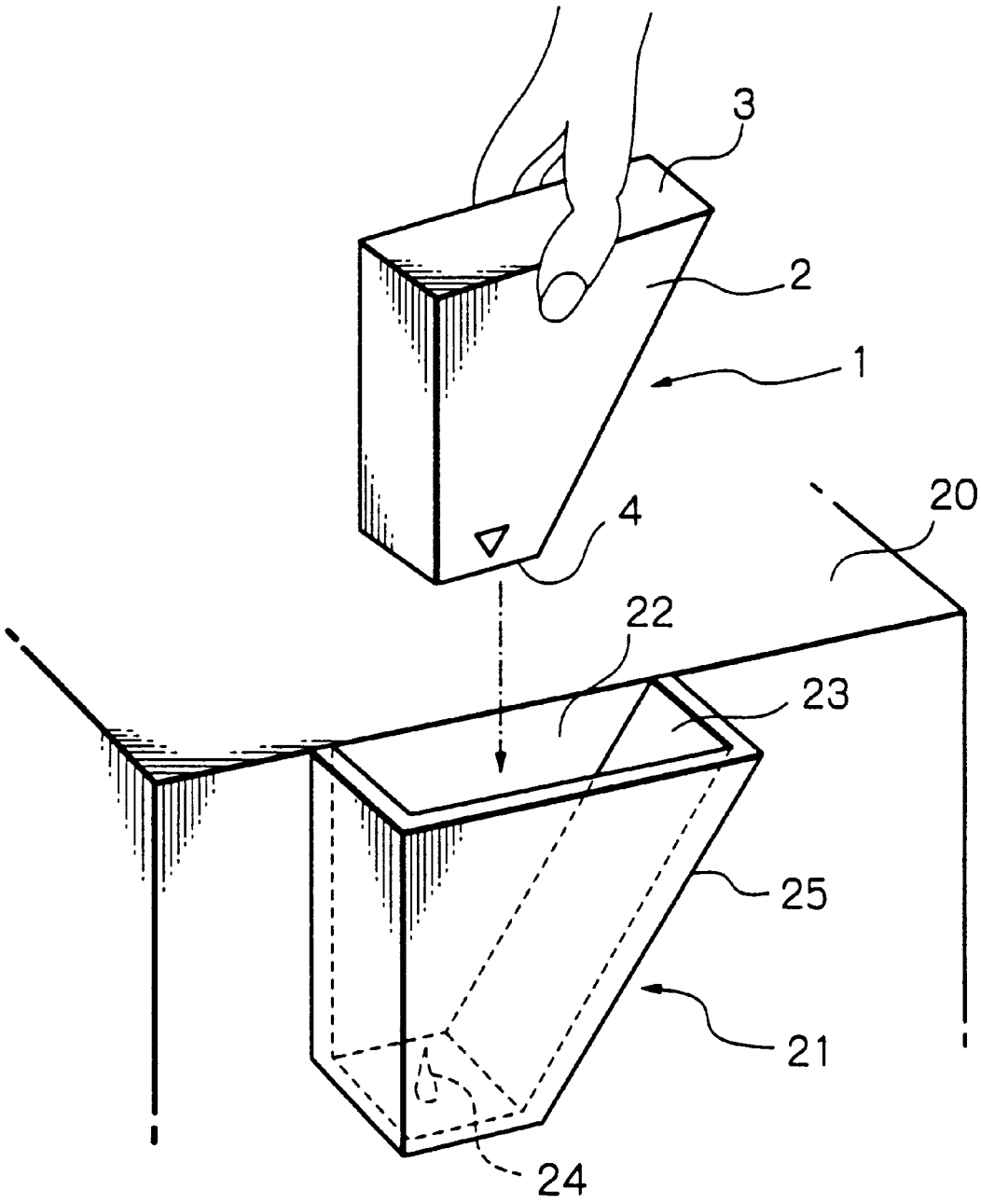
FIG. 6 is an isometric view showing a receptacle formed in an image forming apparatus for receiving the toner container of the illustrative embodiment.
Figure 7:
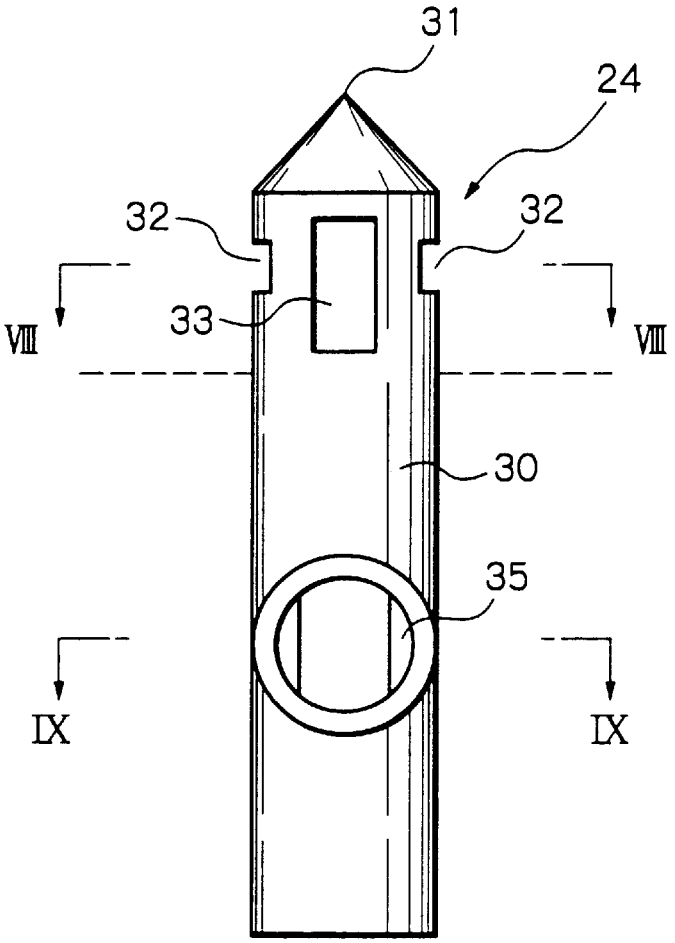
FIG. 7 is a side elevation showing a specific configuration of a nozzle included in the receptacle.
Figure 8:
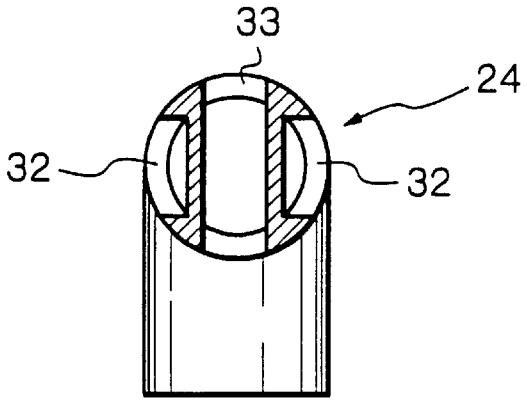
FIG. 8 i,s a section along line VIII—VIII of FIG. 7.
Figure 9:
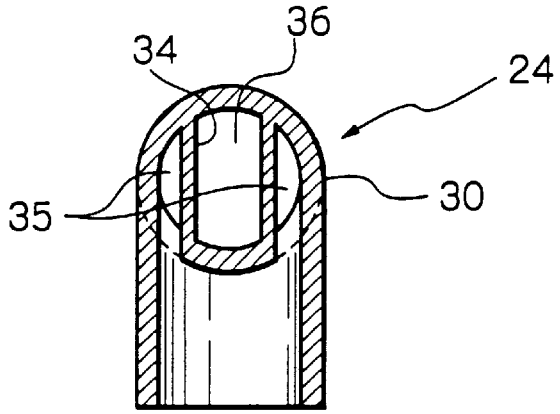
FIG. 9 i,s a section along line IX—IX of FIG. 7.
Figure 10:
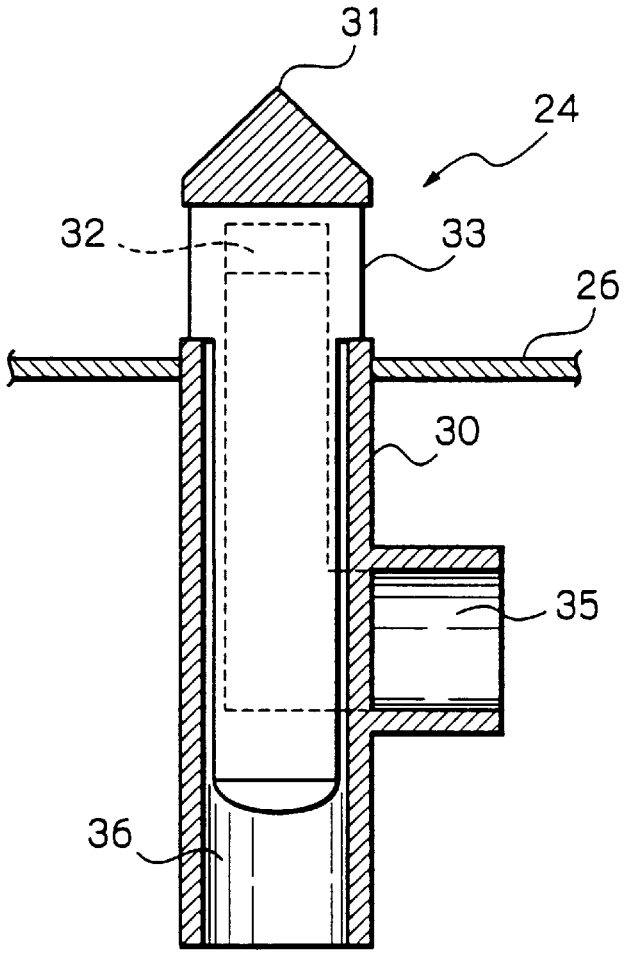
FIG. 10 is a vertical section of the nozzle along the center.

Reference will be made to FIG. 6 for describing an image forming apparatus to which the toner container 1 is applicable. As shown, the image forming apparatus includes a body 20 formed with a receptacle 21 for receiving the toner container 1. The receptacle 21 may be located at a position inside of the body 20 which is uncovered when, e.g., a door is opened, or on the outside of the body 20. The receptacle 21 has an opening 22 at its top for receiving the toner container 1. A support portion 3 supports the toner container 1 received in the receptacle 21. A nozzle or penetrating member 24 is positioned on the bottom of the receptacle 23. In the illustrative embodiment, the support portion 23 is implemented by a frame 25 and complementary in shape to the toner container 1. Therefore, the front of the frame 25 is trapezoidal like the front 2 of the toner container 1.

Figure 11:
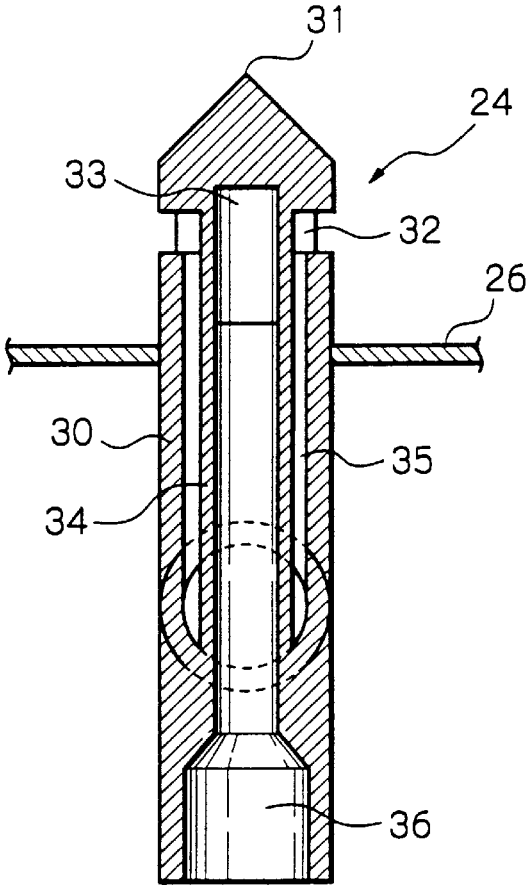
FIG. 11 is a vertical section of the nozzle shifted by 90 degrees from the position shown in FIG. 10.

As shown in FIGS. 7–11, the nozzle 24 has a hollow cylindrical body 30 and protrudes upward from a bottom plate 26 into the receptacle 23. The body 30 has a pointed end 31 having a conical cross-section at the upper end of its portion positioned in the receptacle 23. Air inlets 32 and toner outlets 33 are formed in the body 30 below the pointed end 31 at substantially the same level as each other. Partitions 34 form air passageways 35 and a toner passageway 36 in the nozzle body 30. The air passageways 35 and toner passageway 36 are fluidly communicated to the air inlets 32 and toner outlets 33, respectively. As best shown in FIG. 11, the air passageways 35 are bent sideways in the portion of the body 30 below the bottom plate 26 while the toner passageway 36 extends linearly downward. An air pump, not shown, is communicated to the air passageways 35. The toner passageway 36 is communicated to a suction type screw pump not shown.

The toner container 1 is inserted into the receptacle 21 via the opening 22 with the toner outlet 11, i.e., the bottom 4 facing downward. Because the front 2 of the toner container 1 has a trapezoidal configuration asymmetric with respect to the vertical center line, any person can set the toner container 1 in the receptacle 21 correctly and easily. Further, because the toner container 1 is set at a preselected position without fail, it is easy to align the toner outlet 10 and nozzle 24. When the toner container 1 fully rests on the bottom plate 26, the upper portion of the nozzle 24 penetrates the container 1 by piercing the seal member 11.

In the above condition, toner can be periodically replenished from the toner container 1 to a developing device, not shown, as needed. It is therefore needless for the operator to introduce the toner of the toner container 1 into the developing device or a hopper adjoining it via an exclusive mechanism. To replenish the toner, the air pump is operated to cause air to flow into the toner container 1 via the air inlets 32. This air flows in to the toner container 1 at a position close to the bottom of the container 1 and thereby fluidizes the toner while filling up the container 1. As a result, the toner is discharged from the toner container 1 into the toner passageway 36 via the toner outlets 33. The toner discharged from the toner container 1 is conveyed to the developing device by the suction type screw pump.

Figure 12:
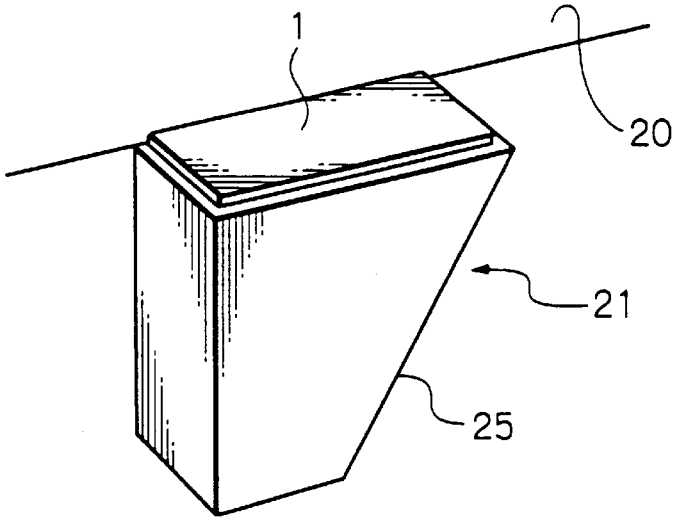
FIG. 12 is an isometric view showing the toner container of the illustrative a embodiment set in the receptacle.

It may accidentally occur that when the toner container 1 is set in the receptacle 21, the pointed end 31 of the nozzle 24 abuts against the seal member 11, but does not pierce it, due to a short pressing force exerted on the container 1. To allows the operator to easily see such defective mounting of the toner container 1, the frame 25 is configured such that its top becomes substantially flush with the top 3 of the container 1 (see FIG. 12). That is, the receptacle 23 is substantially identical in size and configuration as the toner container 1.

When the toner container 1 is not set in the expected position in the receptacle 23, the upper portion of the container 1 protrudes above the top of the frame 25 and can be easily seen by eye. The operator should only push down the toner container 11 to the expected position in the receptacle 23. Because the top of the toner container 1 and that of the frame 25 are substantially flush with each other, the operator is prevented from inadvertently picking up the container 1 when the toner is still available in the container 1. When the toner container 1 almost runs out of toner, the suction type screw pump draws air out of the container 1 and thereby collapses the container 1 to a certain degree. At this instant, the folds 12 allow the toner container 1 to collapse to the position shown in FIG. 5B. In this condition, the operator is capable of easily picking up the collapsed toner container 1 from the receptacle 21 by using clearances formed between the container 1 and the receptacle 21.

Figure 13:
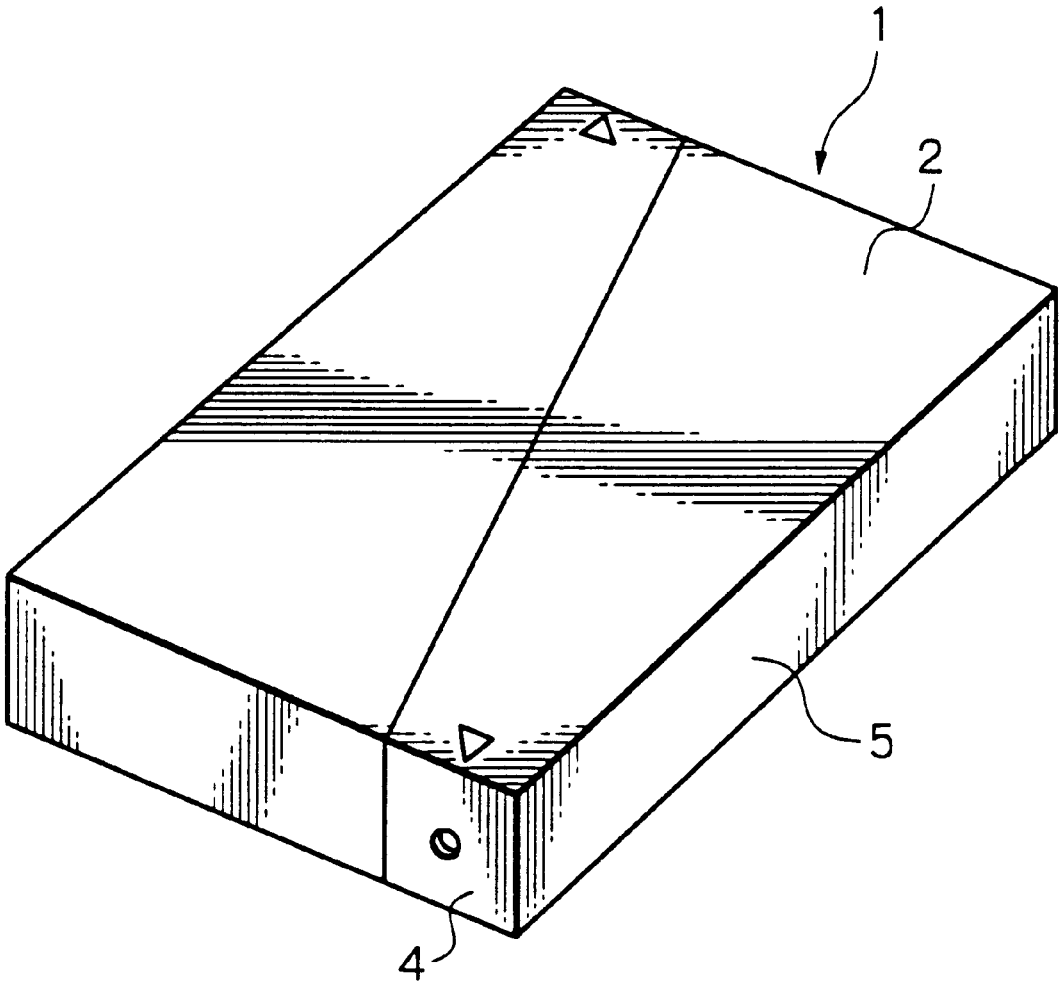
FIG. 13 is an isometric view showing a modification of the illustrative embodiment.

To minimize the amount of toner to remain in the toner container 1, the container 1 should preferably have its inner periphery coated with a low friction material or otherwise treated to reduce friction. In addition, the angle of the inclined side 6 may be increased. For this purpose, as shown in FIG. 13, the front 2 and rear 7 each may be implemented by a trapezoid produced by cutting a rectangle of regular size with a line extending obliquely from one short side to the other short side. If desired, a rectangle may be divided into an even number of trapezoids, e.g., four trapezoids.

Toner for electrophotography lacks fluidity, as well known in the art. Should such toner bridge in the toner container 1, it might fail to drop to the bottom 4 where the toner outlet 10 is present. In the illustrative embodiment, the two sides 5 and 6 adjoining the bottom 4 are asymmetric to each other with respect to the toner outlet 10. More specifically, assuming that the angle between the bottom 4 and the side is $\theta 1$ while the angle between the bottom 4 and the side 6 is $\theta 2$, then the angles $\theta 1$ and $\theta 2$ are not equal to each other. Therefore, pressures which the walls of the toner container 1 exert on the toner are not balanced and cause a minimum of toner to bridge. Particularly, air flowing into the toner container 1 via the center of the bottom 4 is apt to press the toner against the walls of the container 1 and causes it to deposit symmetrically thereon. The toner symmetrically deposited on the walls of the toner container 1 would reach equilibrium and bridge. This kind of bridging is also reduced to a significant degree because the angles $\theta 1$ and $\theta 2$ are not equal to each other.

Figure 14A:
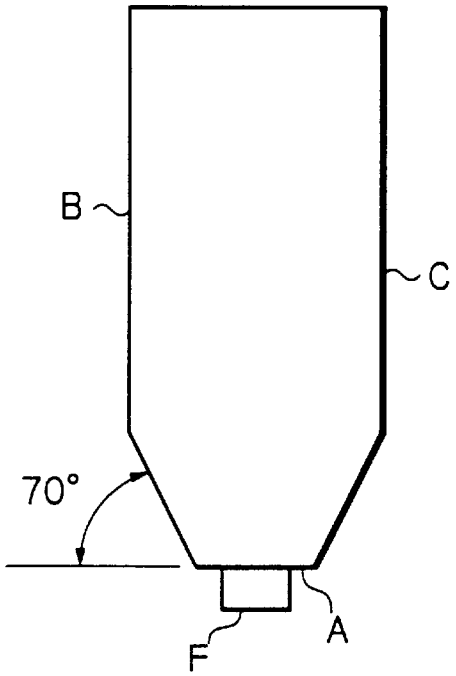
FIGS. 14A and 14B are respectively a side elevation and a front view showing an experimental toner container implemented by the illustrative embodiment.
Figure 14B:
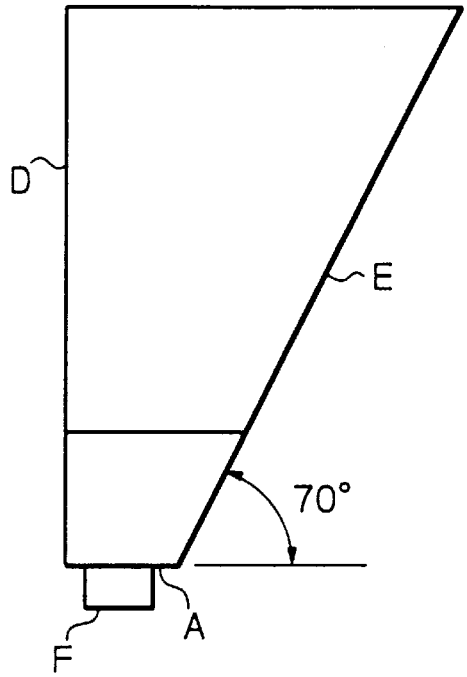
Figure 15A:
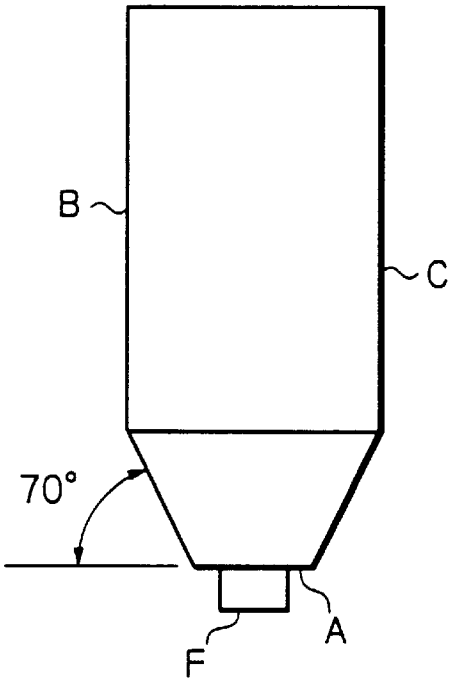
FIGS. 15A and 15B are respectively a side elevation and a front view showing a comparative toner container.
Figure 15B:
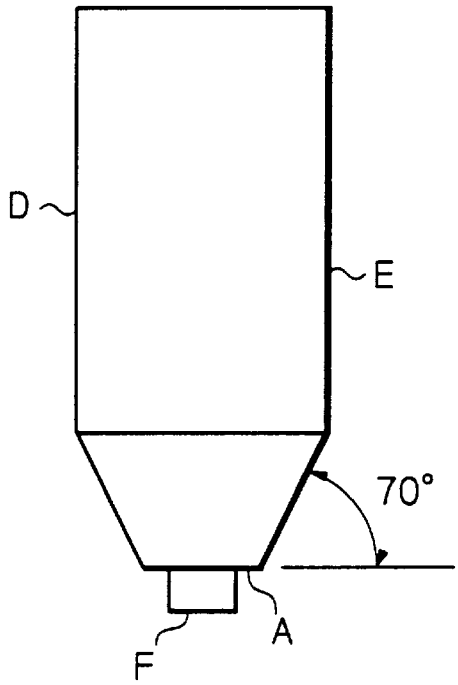

FIGS. 14A and 14B show a toner container having the configuration of the illustrative embodiment in a side elevation and a front view, respectively. FIGS. 15A and 15B are respectively a side elevation and a front view showing a comparative toner container. The toner container shown in FIG. 14A includes two sides B and C adjoining a bottom A and symmetric to each other with respect to a toner outlet F. However, as shown in FIG. 14B, two sides D and E adjoining the bottom A are asymmetric to each other with respect to the toner outlet F. By contrast, in the toner container shown in FIGS. 15A and 15B, all sides are symmetric to each other. Results of experiments conducted with such two toner containers are as follows.

The two toner containers were filled with 300 g of color toner of the same kind (packing ratio of 46%). The amounts of toner to remain in the toner containers were measured under the same conditions relating to air and suction. It was found that the toner remained in the toner container of FIGS. 14A and 14B in an amount of 38.8 g, but remained in the toner container of FIGS. 15A and 15B in an amount of 69.6 g. This difference presumably stems from the side D and bottom A of the illustrative embodiment substantially perpendicular to each other. The other sides B, C and E of the illustrative embodiment and all the sizes of the toner container of FIGS. 15A and 15B are inclined by 70 degrees with respect to the bottom A and presumably cause a greater amount of toner to remain. It is to be noted that a toner container without any inclined surface would fail to smoothly guide toner to the toner outlet F, and that a configuration causing a great amount of toner to remain is likely to cause toner to bridge.

In summary, it will be seen that the present invention provides a toner container and an image forming apparatus using the same having various unprecedented advantages, as enumerated below.

(1) A plurality of toner containers can be stacked for storage and cause a minimum of toner thereof to cohere.

(2) The toner container can be stored in a stable position.

(3) Toner in the toner container balances little and therefore bridges little.

(4) The amount of toner to remain in the toner container is reduced while bridging little.

(5) The toner container can be collapsed when collected, reducing the transport cost to a noticeable degree.

(6) The toner container can be produced at a low cost, can be recycled, and can even be formed of recycled paper.

(7) The collapsed toner container is small enough to be easily collected and transported.

(8) The volume of the toner container can be easily reduced.

(9) Manual replenishment of toner which is apt to cause the toner to fly about is not necessary.

(10) A plurality of toner containers can be neatly stored because two of them form a square or a rectangle with their inclined sides contacting each other.

(11) The image forming apparatus is capable of replenishing the toner from the toner container to a developing section, as needed.

(12) The image forming apparatus is capable of smoothly delivering the toner with an air pressure despite that the toner container is hermetically sealed.

(13) The image forming apparatus allows the toner container to be easily and surely set thereon by hand.

(14) The toner can be discharged from the toner container via a nozzle inserted into the container.

(15) The nozzle can easily penetrate the toner container.

(16) A single nozzle should only be inserted into the toner container.

Various modifications will become possible for those skilled in the art after receiving the teachings of the present disclosure without departing from the scope thereof.

What is claimed is:

1. A toner container for powdery toner for an electrophotographic image forming apparatus, comprising:

a toner discharge surface having a toner outlet configured to discharge the powdery toner;

a side surface perpendicularly extending from said toner discharge surface; and a slanted side surface facing said side surface and extending outwardly from said toner discharge surface.

2. A toner container as claimed in claim 1, wherein said toner container has a polygonal configuration including said toner discharge surface, said side surface and said slanted side surface.

3. A toner container as claimed in claim 1, wherein said side surface and said slanted side surface are connected by two flat surfaces extending parallel to each other from said discharge surface and having an identical size and an identical shape, said two flat surfaces each having a greater surface area than other surfaces.

4. A toner container as claimed in claim 1, where said toner container comprises a flexible material.

5. A toner container as claimed in claim 4, wherein said toner container comprises at least one paper.

6. A toner container as claimed in claim 1, wherein said toner container is configured to collapse after the powdery toner has been used up.

7. A toner container as claimed in claim 6, wherein said toner container is configured to fold.

8. A toner container as claimed in claim 1, wherein:

said side surface and said slanted side surface are connected by two flat surfaces extending parallel to each other from said toner discharge surface; and said two flat surfaces have a same surface area.

9. A toner container as claimed in claim 8, wherein said two flat surfaces have a trapezoidal shape.

10. An image forming apparatus, comprising:

an apparatus body;

a toner container configured to be set on the apparatus body and store powdery toner for the image forming apparatus, the toner container including a toner discharge surface having a toner outlet configured to discharge the powdery toner, a side surface perpendicularly extending from said toner discharge surface and a slanted side surface facing said side surface and extending outwardly from said toner discharge surface;

a developing device configured to receive the powdery toner from said toner container to replenish the powdery toner in said developing device as needed.

11. An apparatus as claimed in claim 10, wherein said apparatus body includes a receptacle configured to receive said toner container with said toner outlet facing downward.

12. An apparatus as claimed in claim 11, wherein said receptacle includes a recess having a shape complementary to said toner container.

13. An apparatus as claimed in claim 11, wherein:

said receptacle has an opening in a top thereof; and said toner container is inserted into said receptacle via said opening.

14. An apparatus as claimed in claim 11, wherein said receptacle includes a penetrating member configured to penetrate into said toner container via said toner outlet.

15. An apparatus as claimed in claim 14, wherein said penetrating member has a pointed end at a top thereof.

16. An apparatus as claimed in claim 15, wherein said developing device receives the powdery toner from the toner container via said penetrating member.

17. An image forming apparatus, comprising:

an apparatus body;

a toner container configured to be set on the apparatus body and store powdery toner for the image forming apparatus, the toner container including a toner discharge surface having a toner outlet configured to discharge the powdery toner, a side surface perpendicularly extending from said toner discharge surface and a slanted side surface facing said side surface and extending outwardly from said toner discharge surface;

a developing device configured to receive the powdery toner from said toner container to replenish the powdery toner in said developing device and inject air into said toner container to discharge the powdery toner from said toner container.

18. An apparatus as claimed in claim 17, wherein:

said apparatus body includes a receptacle configured to receive said toner container; and said toner container is inserted into said receptacle with said toner outlet facing downward.

19. An apparatus as claimed in claim 18, wherein said receptacle includes a recess having a shape complementary to said toner container.

20. An apparatus as claimed in claim 18, wherein:

said receptacle has an opening in a top thereof; and said toner container is inserted into said receptacle via said opening.

21. An apparatus as claimed in claim 18, wherein said receptacle includes a penetrating member configured to penetrate into said toner container via said toner outlet.

22. An apparatus as claimed in claim 21, wherein said penetrating member has a pointed end at a top thereof.

23. An apparatus as claimed in claim 22, wherein the developing device receives the powdery toner from the toner container via said penetrating member.

24. A toner container for powdery toner for an electrophotographic image forming apparatus, comprising:

a toner discharge surface having a toner outlet configured to discharge the powdery toner;

a side surface perpendicularly extending from said toner discharge surface;

a slanted side surface facing said side surface and extending outwardly from said toner discharge surface; and two opposite surfaces connecting said side surface and said slanted side surface and adjoining said toner discharge surface, said two opposite surfaces each having a same trapezoidal shape and being asymmetric to each other with respect to a center portion of said toner outlet.

25. A toner container as claimed in claim 24, wherein one of said two opposite surfaces extends perpendicular to said toner discharge surface.

26. A toner container as claimed in claim 24, wherein:

said two opposite surfaces are flat; and said two opposite surfaces each are inclined by a particular angle relative to said toner discharge surface.

27. A toner container as claimed in claim 26, wherein one of said two opposite surfaces is perpendicular to said toner discharge surface.

28. A toner container as claimed in claim 24, wherein said toner container comprises a flexible material.

29. A toner container as claimed in claim 28, wherein said toner container comprises at least one paper.

30. A toner container as claimed in claim 24, wherein said toner container is configured to collapse after the powdery toner has been used up.

31. A toner container as claimed in claim 30, wherein said toner container is configured to fold.

32. A toner container as claimed in claim 24, wherein said two opposite surfaces have a same surface area.

33. A toner container as claimed in claim 24, wherein said two opposite surfaces comprises a trapezoidal shape.

34. An image forming apparatus, comprising:

an apparatus body;

a toner container configured to be set on the apparatus body and store powdery toner for the image forming apparatus, the toner container including a toner discharge surface having a toner outlet configured to discharge the powdery toner, a side surface perpendicularly extending from said toner discharge surface, and a slanted side surface facing said side surface and extending outwardly from said toner discharge surface, and two opposite surfaces connecting said side surface and said slanted side surface and adjoining said toner discharge surface, said two opposite surfaces each having a same trapezoidal shape and being asymmetric to each other with respect to a center portion of said toner outlet; and a developing device configured to receive the powdery toner from said toner container to replenish the powdery toner in said developing device from said toner container as needed.

35. An apparatus as claimed in claim 34, wherein:

said apparatus body includes a receptacle configured to receive said toner container;

said toner container is inserted into said receptacle with said toner outlet facing downward.

36. An apparatus as claimed in claim 35, wherein said receptacle includes a recess having a shape complementary to said toner container.

37. An apparatus as claimed in claim 35, wherein:

said receptacle has an opening in a top thereof; and said toner container is inserted into said receptacle via said opening.

38. An apparatus as claimed in claim 35, wherein said receptacle includes a penetrating member configured to penetrate into said toner container via said toner outlet.

39. An apparatus as claimed in claim 38, wherein said penetrating member has a pointed end at a top thereof.

40. An apparatus as claimed in claim 39, wherein the developing device receives the toner from the toner container via said penetrating member.

41. An image forming apparatus, comprising:

an apparatus body;

a toner container configured to be set on the apparatus body and store powdery toner for the image forming apparatus, the toner container including a toner discharge surface having a toner outlet configured to discharge the powdery toner, a side surface perpendicularly extending from said toner discharge surface, and a slanted side surface facing said side surface and extending outwardly from said toner discharge surface, and two opposite surfaces connecting said side surface and said slanted slide surface and adjoining said toner discharge surface, said two opposite surfaces each having a same trapezoidal shape and being asymmetric to each other with respect to a center of said toner outlet; and developing device configured to receive the powdery toner from said toner container to replenish the toner in said developing device and inject air into said toner container to discharge the powdery toner from said toner container.

42. An apparatus as claimed in claim 41, wherein:

said apparatus body includes a receptacle configured to receive said toner container; and said toner container is inserted into said receptacle with said toner outlet facing downward.

43. An apparatus as claimed in claim 42, wherein said receptacle includes a recess having a shape complementary to said toner container.

44. An apparatus as claimed in claim 42, wherein:

said receptacle has an opening in a top thereof; and said toner container is inserted into said receptacle via said opening.

45. An apparatus as claimed in claim 42, wherein said receptacle includes a penetrating member configured to penetrate into said toner container via said toner outlet.

46. An apparatus as claimed in claim 45, wherein said penetrating member has a pointed end at top thereof.

47. An apparatus as claimed in claim 46, wherein the developing device receives the powdery toner from the toner container via said penetrating member.

48. An image forming apparatus, comprising:

a toner container configured to store powdery toner for the image forming apparatus, the toner container including a toner discharge surface having a toner outlet configured to discharge the powdery toner;

an apparatus body including a receptacle configured to receive the toner container such that the toner outlet faces downward;

a developing device to which the powdery toner is replenished from said toner container; and a penetrating device provided in said receptacle and configured to penetrate into the toner container, inject air into the toner container and transfer the powdery toner from the toner container to the developing device as needed.

49. An apparatus as claimed in claim 48, wherein said penetrating device has a pointed end at a top thereof.

50. An apparatus as claimed in claim 49, wherein said penetrating device comprises a hollow cylindrical body having at least one air inlet and at least one toner outlet on a surface thereof and at least one air passage and at least one toner passage inside the hollow cylindrical body.

51. An image forming apparatus, comprising:

a toner container configured to store powdery toner for the image forming apparatus, the toner container including a toner discharge surface having a toner outlet configured to discharge the powdery toner;

an apparatus body including a receptacle configured to receive the toner container such that the toner outlet faces downward;

a developing device to which the powdery toner is replenished from said toner container; and penetrating means for penetrating into the toner container, injecting air into the toner container and transferring the powdery toner from the toner container into the developing device as needed.

52. An apparatus as claimed in claim 51, wherein said penetrating means has a pointed end at a top thereof.

53. An apparatus as claimed in claim 52, wherein said penetrating means comprises a hollow cylindrical body having at least one air inlet and at least one toner outlet on a surface thereof and at least one air passage and at least one toner passage inside the hollow cylindrical body.

54. An image forming apparatus, comprising:

a toner container configured to store powdery toner for the image forming apparatus, the toner container including a toner discharge surface having a toner outlet configured to discharge the powdery toner, a side surface perpendicularly extending from said toner discharge surface and a slanted side surface facing said side surface and extending outwardly from said toner discharge surface;

an apparatus body including a receptacle configured to receive the toner container such that the toner outlet faces downward;

a developing device to which the powdery toner is replenished from said toner container; and a penetrating device provided in said receptacle and configured to penetrate into the toner container, inject air into the toner container and transfer the powdery toner from the toner container to the developing device as needed.

55. An apparatus as claimed in claim 54, wherein said penetrating device has a pointed end at a top thereof.

56. An apparatus as claimed in claim 55, wherein said penetrating device comprises a hollow cylindrical body having at least one air inlet and at least one toner outlet on a surface thereof and at least one air passage and at least one toner passage inside the hollow cylindrical body.

57. An image forming apparatus, comprising:

a toner container configured to store powdery toner to for the image forming apparatus, the toner container including a toner discharge surface having a toner outlet configured to discharge the powdery toner, a side surface perpendicularly extending from said toner discharge surface; and a slanted side surface facing said side surface and extending outwardly from said toner discharge surface, two opposite surfaces connecting said side surface and said slanted side surface and adjoining said toner discharge surface, said two opposite surfaces being asymmetric to each other with respect to said toner outlet;

an apparatus body including a receptacle configured to receive the toner container such that the toner outlet faces downward;

a developing device to which the powdery toner is replenished from said toner container; and a penetrating device provided in said receptacle and configured to penetrate into the toner container, inject air into the toner container and transfer the powdery toner from the toner container to the developing device as needed.

58. An apparatus as claimed in claim 57, wherein said penetrating device has a pointed end at a top thereof.

59. An apparatus as claimed in claim 58, wherein said penetrating device comprises a hollow cylindrical body having at least one air inlet and at least one toner outlet on a surface thereof and at least one air passage and at least one toner passage inside the hollow cylindrical body.

* * * * *